US007837414B2

(12) United States Patent
Heseldon

(10) Patent No.: US 7,837,414 B2
(45) Date of Patent: Nov. 23, 2010

(54) GABIONS

(75) Inventor: James Heseldon, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 65 days.

(21) Appl. No.: 12/299,324

(22) PCT Filed: Aug. 23, 2006

(86) PCT No.: PCT/GB2006/050257

§ 371 (c)(1),
(2), (4) Date: Dec. 9, 2008

(87) PCT Pub. No.: WO2007/135352

PCT Pub. Date: Nov. 29, 2007

(65) Prior Publication Data

US 2009/0202308 A1 Aug. 13, 2009

(30) Foreign Application Priority Data

May 19, 2006 (GB) ..... 0610054.9

(51) Int. Cl.
*E02D 29/02* (2006.01)

(52) U.S. Cl. ..... 405/284; 405/15

(58) Field of Classification Search ..... 405/15, 405/16, 17, 18, 30, 31, 262, 284, 286, 287
See application file for complete search history.

(56) References Cited

U.S. PATENT DOCUMENTS

| | | | | |
|---|---|---|---|---|
| 5,050,765 | A | 9/1991 | Roser et al. | |
| 5,076,735 | A * | 12/1991 | Hilfiker | 405/284 |
| 5,320,455 | A * | 6/1994 | Mattox | 405/284 |
| 5,333,970 | A | 8/1994 | Heselden | |
| 5,472,297 | A * | 12/1995 | Heselden | 405/286 |
| 5,582,492 | A * | 12/1996 | Doyle, Jr. | 405/262 |
| 5,636,938 | A * | 6/1997 | Ragazzo | 405/15 |
| 5,836,129 | A * | 11/1998 | Jaecklin | 52/612 |
| 7,670,082 | B2 * | 3/2010 | Olsta et al. | 405/15 |
| 2001/0002968 | A1 * | 6/2001 | Black | 405/15 |

FOREIGN PATENT DOCUMENTS

| | | |
|---|---|---|
| CA | 2086588 A1 | 7/1994 |
| DE | 8502951 U1 | 7/1985 |
| DE | 8502951 U1 | 8/2006 |

(Continued)

OTHER PUBLICATIONS

International Search Report, Written Opinion of the International Searching Authority, and International Preliminary Report on Patentability of International Patent Application No. PCT/GB2006/050257, filed Aug. 23, 2006.

(Continued)

*Primary Examiner*—Frederick L Lagman
(74) *Attorney, Agent, or Firm*—Ping Wang; Andrews Kurth, LLP

(57) ABSTRACT

A gabion 10 comprising side walls 12 defining a cavity 20 suitable for retaining a quantity of fill material 36 and a base 14 connected to at least one side wall 12 for substantially closing the bottom of the gabion 10, said base 14 comprising two or more apertures 27 defining channels 22 arranged to receive lifting means therethrough.

26 Claims, 12 Drawing Sheets

FOREIGN PATENT DOCUMENTS

| | | | | |
|---|---|---|---|---|
| EP | 1186719 | A2 | | 3/2002 |
| EP | 1498552 | A1 | | 1/2005 |
| FR | 2907480 | | * | 4/2008 |
| GB | 2229204 | A | | 9/1990 |
| GB | 2268463 | A | | 1/1994 |
| JP | 07109718 | A | | 4/1995 |
| JP | 09316849 | A | | 12/1997 |
| JP | 2004169404 | A | | 6/2004 |
| JP | 2004263407 | A | * | 9/2004 |
| JP | 2005146661 | A | | 6/2005 |
| JP | 2005171679 | A | * | 6/2005 |
| JP | 2007071007 | A | * | 3/2007 |

OTHER PUBLICATIONS

United Kingdom Patent Office Search Report, Great Britain Patent Application No. GB0616710.0, filed Aug. 23, 2006.

* cited by examiner

GABIONS

FIELD

The present invention relates to gabions, in particular to gabions which can be lifted and maneuvered even when filled.

BACKGROUND

Gabions generally comprise a box or cage structure that can be filled with rocks or earth to create a temporary structure, such as a wall. The gabion serves to retain the fill material, thereby maintaining the integrity of the structure and to prolong the structure's life.

Gabion-based structures have many applications including flood protection and earth retention in civil applications and blast protection in military applications.

A known problem with gabions is that once they are filled, they cannot be easily moved without either damaging the gabion or losing the fill material. Because gabions are usually made from relatively weak materials (e.g. wire meshes), they are unsuited to being lifted once filled (e.g. using a crane) because they bend, tear or distort.

Moreover, for civil applications silt, soil or vegetation may fill the interstitial voids between the fill material, thereby increasing the effectiveness of the structure. However, as the interstitial voids fill, the weight of the structure also increases making it more difficult to relocate the gabion without causing damage to the structure. Indeed, in such cases it may be necessary to empty the gabion so that it can be relocated.

DETAILED DESCRIPTION

Figure 1:
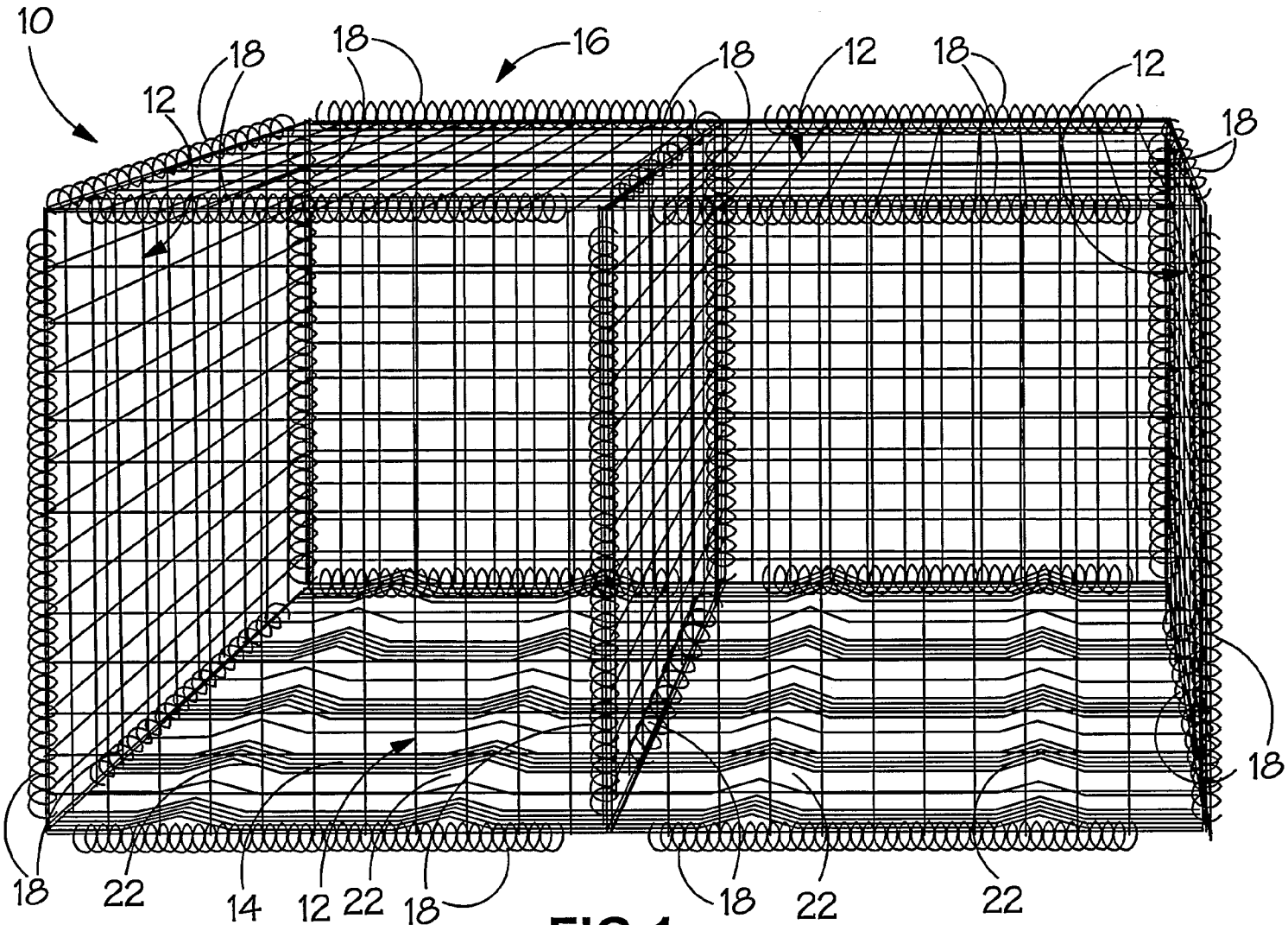
FIG. 1 is a perspective view of a gabion in accordance with the invention.

It is therefore an object of the present invention to provide an improved gabion that can be more easily moved into position relocated once positioned and one which provides solutions to one or more of the above mentioned problems.

According to the present invention, there is provided a gabion comprising sidewalls defining a cavity suitable for retaining a quantity of fill material and a base closing the bottom of the gabion, to prevent fill material falling from the gabion when the filled gabion is lifted, the gabion being provided in the region of said base with at least two channels at spaced apart locations along the gabion and connected to or integrally formed with the base and extending from one sidewall of the gabion to another side wall thereof, each channel being adapted to receive therethrough an elongate lifting member such that when the gabion is lifted by means of the lifting members, each lifting member bears against the top of the channel in which it is received and the lifting load is thereby spread along the channels.

The channels may be continuous, defining one top surface against which the lifting members bear during lifting of the gabion thereby. In such a case, the channels may be formed from elongate pipe or tube members connected to the base.

Alternatively, the channels may be discontinuous, providing a multiplicity of top surfaces along the length of the channels against which the lifting members bear during lifting of the gabion thereby. In such a case the channels may be formed from elongate helical members. Such a member may particularly advantageously be used when the base is formed of a mesh material, as the coil may then be inter-meshed with the base material. Alternatively, the channels may be formed of ridges provided in the base.

The channels may extend from one sidewall of the gabion to an opposite sidewall thereof, and/or from one sidewall of the gabion to a neighbouring sidewall thereof.

Preferably, the channels are arranged symmetrically with respect to each other so as to spread the load evenly across the gabion when lifted.

The channels may be any suitable shape in cross-section, for example rectilinear, triangular or circular.

The lifting members may be bars, rods or cables, and the gabion is generally lifted by mechanical lifting means suitably connected to protruding ends of the lifting members.

Thus, according to one of its aspects the invention provides a gabion comprising sidewalls defining a cavity suitable for retaining a quantity of fill material and a base connected to at least one sidewall for substantially closing the bottom of the gabion, said base comprising two or more apertures defining channels arranged to receive lifting means therethrough.

A second aspect of the invention provides a gabion in the form of an open-topped cage structure having a cavity defined by sidewalls and a base, which cavity can be filled using a fill material introduced through the open top, said base comprising two or more apertures defining channels arranged to receive lifting means therethrough.

Preferably, the or each channel is substantially straight. The apertures can have any suitable cross-section, for example a round, a square or a triangular cross-section. Each path may extend from one edge of the base to the opposite edge of the base or from one edge of the base to an adjacent edge thereof. Any number of apertures may be provided, although minimum of two are required to define a path suitable for receiving the lifting means.

Each path can be defined by two or more apertures fixably attached to the base of the gabion, whereby the apertures can be formed of any appropriate material, e.g. steel, and in any appropriate shape, e.g. ring-shaped. Indeed each path can be defined by an elongate pipe or tube fixably attached to the base of the gabion. Yet further, each path may be defined by one or more helical members, through which the lifting means can be inserted. The helical member can have any appropriate pitch, and can be formed of any appropriate material, such as a steel spring or coil.

The invention provides a gabion whereby when the gabion is placed on a floor, each path defines a channel under the base, i.e. an elongate space is created between the base and the floor.

Each path is preferably configured to receive a lifting bar. In a more specialised embodiment, two or more of the channels may be configured to receive the forks of a fork lift truck.

Providing a path configured to receive a lifting bar removes the need to deform the base of the gabion to allow such reception.

The lifting bar, where provided, may be of any suitable type, e.g. a steel rod. The lifting bar may have hoisting points at ends thereof, e.g. an eye formation on one or both ends. The hoisting points may be detachable, e.g. screw-threadedly connected to the ends of the rod. The length of the lifting bar is ideally longer than the corresponding dimension of the gabion such that it protrudes beyond the periphery of the gabion so that e.g. a strop, a sling, a chain or a cable can be attached to each end thereof for hoisting purposes.

The lifting bar may be formed integrally with the base. Where an integral lifting bar is provided, it may be a metal (e.g. steel) rod secured in place using ties (e.g. cable ties or hog rings).

Additionally or alternatively, the sidewalls may comprise one or more hoisting points. In one possible embodiment of the invention, the hoisting points are formed by eyes provided at ends of cables passing under the gabion through the channels formed by the apertures. The ends of the cables, where provided, may be held in place using ties, such as cable ties or hog rings.

One or more dividers may be positioned within the cavity. The divider or dividers, where provided, ideally inhibit movement of the fill material within the cavity, especially lateral movement of the fill material.

A brace or several braces may be provided within the cavity. The braces ideally connect opposing sidewalls to one another in a relatively inextensible manner such that the sidewalls are substantially inhibited from bowing under the outward pressure exerted by the fill material. In one possible embodiment of the invention, the braces are wires connected to opposing sidewalls. Rods, webs, cables or any other item having adequate tensile properties may, of course, be used instead of wires.

The sidewalls, base or dividers can be manufactured of a cage or sheet material.

Suitable cage materials include, amongst others, steel or aluminium meshes (preferably galvanised or painted). Suitable sheet materials include steel, aluminium or plastics sheet materials (again, preferably treated to stand up to prevailing conditions as appropriate).

The sidewalls of the gabion are preferably hingedly connected to one another to enable the gabion to be folded flat. The base is also preferably hingedly connected to at least one of the sidewalls such that it can be folded away for transport etc. Erection of the gabion can therefore take place by swinging the sidewalls out into their desired positions, unfolding the base and then connecting the base at one or more points along each edge to one or more corresponding side panel edges.

The connections can be of any suitable type, although helical members threaded through openings provided at or towards the edges of adjacent sidewalls or the base have proved to be effective in similar situations. One or more of the connections may be releasable, e.g. by providing; two helical members, each helical member being threaded through openings in a sidewall or a base; and a removable pintle connecting the two helical members to one another. The pintle may have a locking member to inhibit unintentional removal thereof e.g. a clip or hook at one end thereof that engages a fixed part of the gabion.

A lid for substantially closing the top of the gabion may be provided. Where a lid is provided, it is preferably hingedly connected to one of the sidewalls of the gabion.

The gabion may have a lining disposed within the cavity to inhibit egress of fill material through the sidewalls or base, or through any spaces between adjacent sidewalls or a side wall and the base. The lining, where provided, is preferably formed in one piece. Ideally, the lining is fabricated from a geotextile material.

A third aspect of the invention provides a method of transporting a gabion having sidewalls and a base defining a cavity, the base having two or more apertures defining channels arranged to receive a lifting bar comprising the steps of; positioning one or more lifting bars in the path defined by the two or more apertures; connecting the ends of each lifting bar to a hoist and hoisting the gabion.

A fourth aspect of the invention provides a method of transporting a gabion having sidewalls and a base defining a cavity, the base having two or more apertures defining channels arranged to receive a cable comprising the steps of; connecting one or more hoisting points provided on the gabion to a hoist; and hoisting the gabion; wherein the hoisting points comprise one or more cables in the channels defined by the two or more apertures.

Once hoisted, the gabion can be moved to a desired location and lowered, whereafter the hoist can be disconnected from the lifting bar or bars or hoisting points. The lifting bar or bars or hoisting point or points can then be removed, if desired. Alternatively, the lifting bars or hoisting points can be left in-situ for subsequent removal of the gabion.

A fifth aspect of the invention provides a method of erecting a gabion having sidewalls and a base defining a cavity, the base having one or more channels that extend into the cavity comprising the steps of;

pacing the gabion on a surface with its base in contact with the surface; and at least part-filling the gabion with fill material.

Additional steps in the erection procedure may include:

Prior to at least part-filling the gabion with fill material, lining part or all of the gabion using a liner, e.g. a geotextile liner.

Part-filling the gabion with fill material, levelling the fill material and then adding more fill material.

Part-filling the gabion (and optionally levelling the fill material), bracing the sidewalls of the gabion using or more relatively inextensible braces connected to opposing or adjacent sidewalls and then adding more fill material.

The fill material can be of any suitable type, such as soil, rocks, sand, concrete, rubble, ice, vegetation and detritus.

Preferred embodiments of the invention shall now be described, by way of example only with reference to the accompanying drawings in which;

Referring to FIG. 1, a gabion 10 in accordance with the invention is shown. The gabion 10 comprises four wire-mesh side walls 12, a wire-mesh base 14 and a wire-mesh lid 16. Edges of adjacent side walls 12, the base 14 and lid 16 are connected along their length by helical springs 18 threaded through the wires 30 defining the edges of each piece. A cavity 20 is thereby defined within the gabion 10. Four grooves 22 are provided in the base 14 by bending the wire-mesh into the cavity 20. A vertical, wire mesh divider 24 is also provided to inhibit lateral movement of fill material (not shown) and to brace the long side walls 14 at their mid-points. The divider 24 is connected at the midpoint of the long side walls 14 and to the base 14 using helical springs 18.

Figure 2:
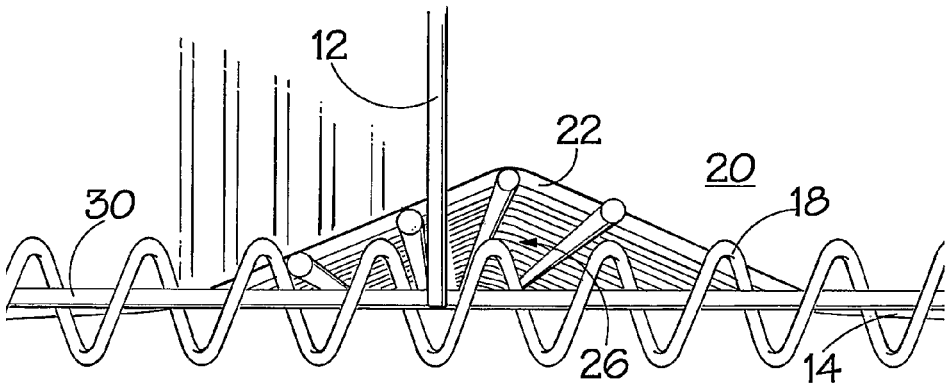
FIG. 2 is a side perspective view of a ridge in the base of the gabion.

As can be seen in FIG. 2, each groove 22 is formed by folding the base 14 upwards into the cavity 20. A channel 26 running all the way under the gabion, having openings at either end, is thereby formed into which a lifting bar can be inserted.

Figure 3:
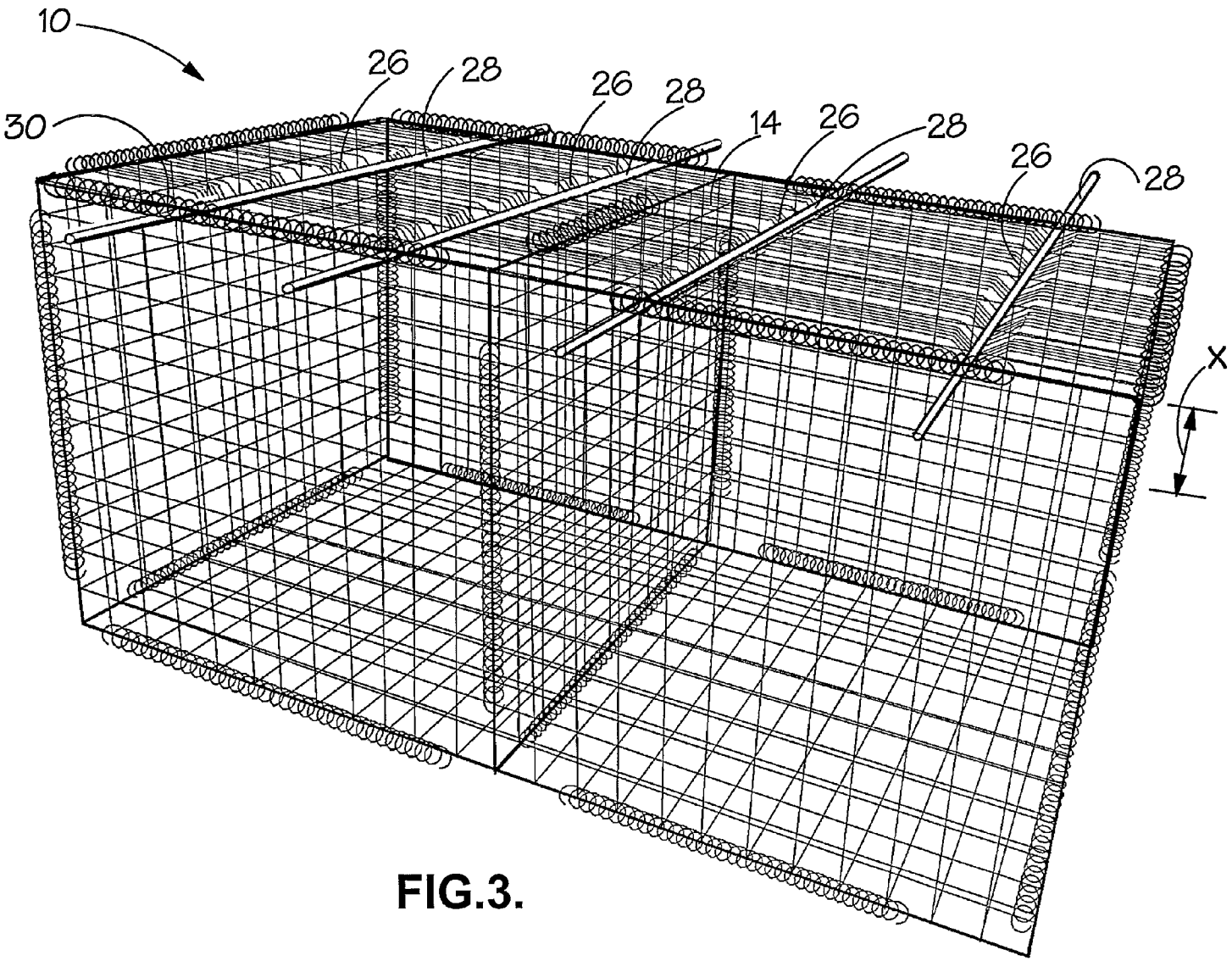
FIG. 3 is a perspective view of an inverted gabion in accordance with the invention with lifting bars positioned in the grooves.

In FIG. 3, it can be seen how steel lifting bars 28 can be slid into each channel 26. The lowermost wire 30 of the long side panels 12 the lifting bar 28 on the opposite side to the groove 26 to retain each lifting bar 28. Where there is little clearance between the lifting bar 28 and the lowermost wire 30, a hammer may be required to knock the lifting bar 28 into position. As can be seen, each lifting bar 28 protrudes x beyond the periphery of the gabion 10.

Figure 4:
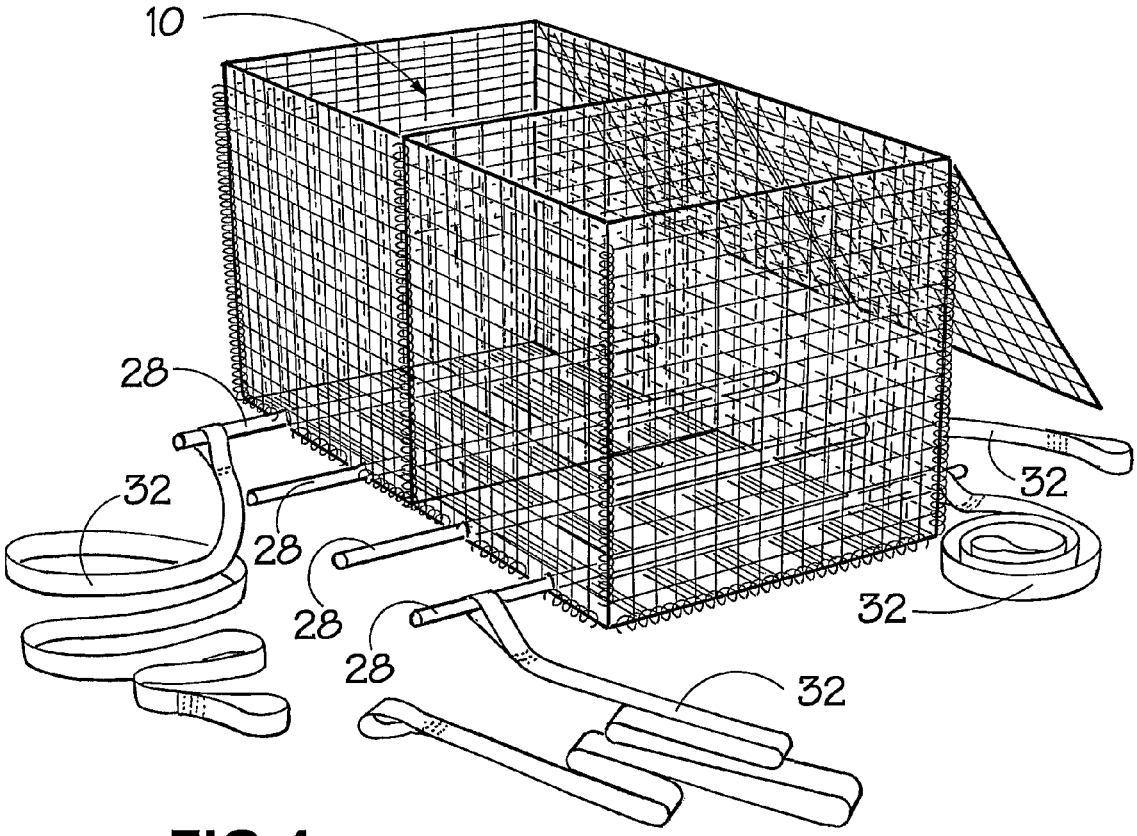
FIG. 4 is a perspective view of an upright gabion in accordance with the invention with lifting bars positioned in the grooves and hoisting straps attached to ends of the lifting bars.

FIG. 4 shows the same gabion 10 as in FIG. 3, except that it has been rotated to an upright orientation. Hoisting straps 32 have been looped under the lifting bars 28, ready for later use.

Figure 5:
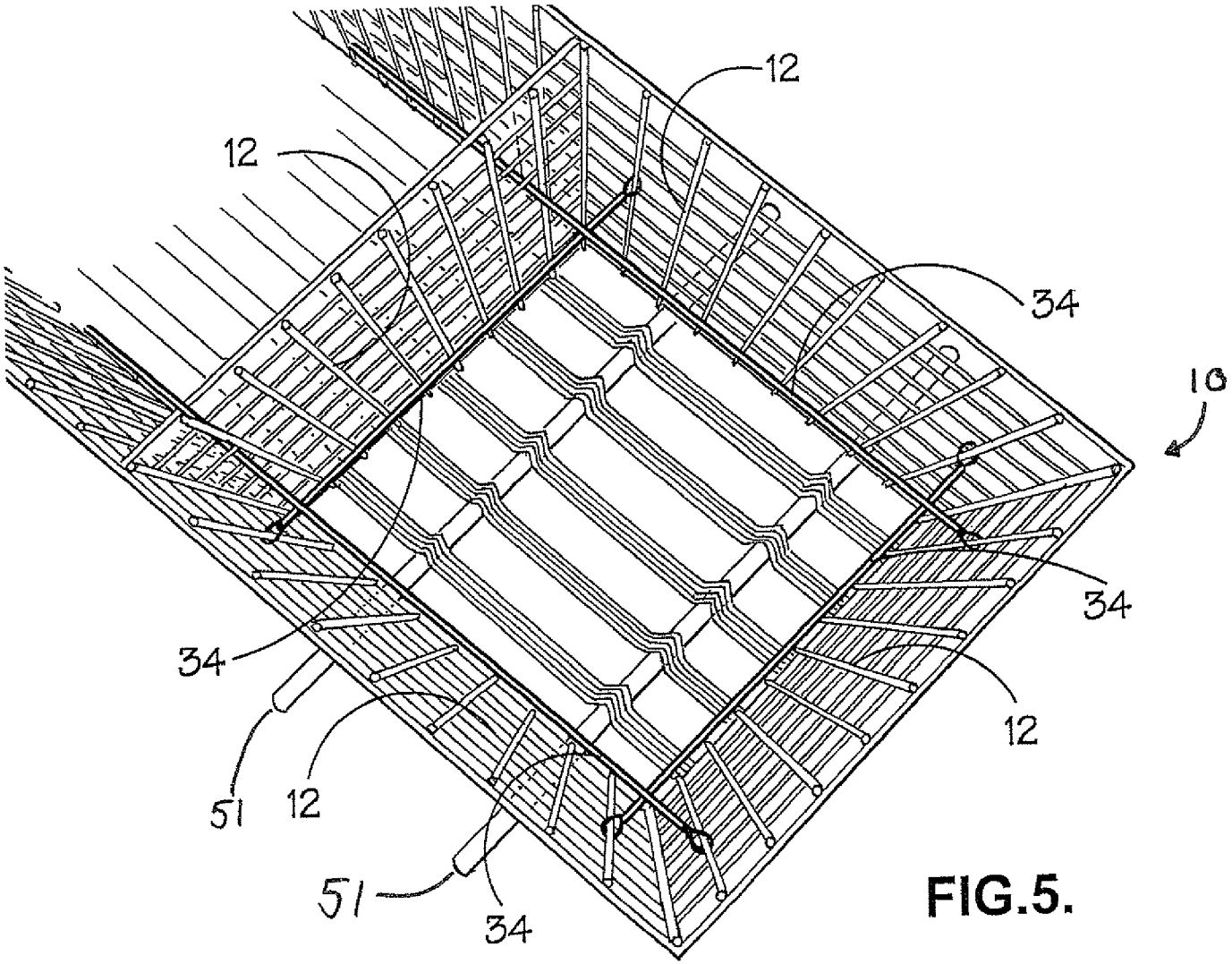
FIG. 5 is a perspective view of the gabion cavity showing the bracing wires for bracing opposite side walls.

FIG. 5 shows bracing wires 34 inside the gabion cavity 20 that inhibit the sidewalls from bowing outwards when the gabion is filled. The bracing wires 34 are pre-cut lengths of high tensile steel wire that are twisted around a wire of a side wall 12 at either end. A ferrule can be used to secure the bracing wires 34 to the side walls 12. The bracing wires 34 are shown running parallel to the side walls 12, although diagonal bracing wires 34 (e.g. running between adjacent side walls) may be provided to "triangulate" the gabion 10 for additional rigidity. A path suitable for receiving a lifting means can be defined by an elongate pipe or tube 51 fixably attached to the base of the gabion 10.

Figure 6:
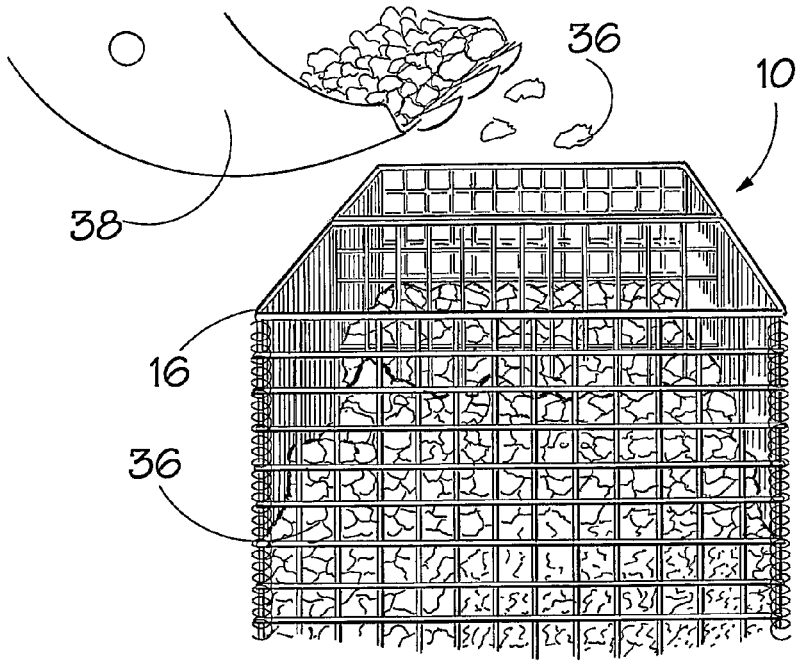
FIG. 6 is a perspective view of a gabion being filled with rocks.

FIG. 6 shows the gabion 10 being part-filled with rocks 36 using a digger 38. Of course, any suitable fill material may be used, and the gabion 10 could be filled by hand. As can be seen, the lid 16 has been swung open to provide an open top through which the rocks 36 can be dropped.

Figure 7:
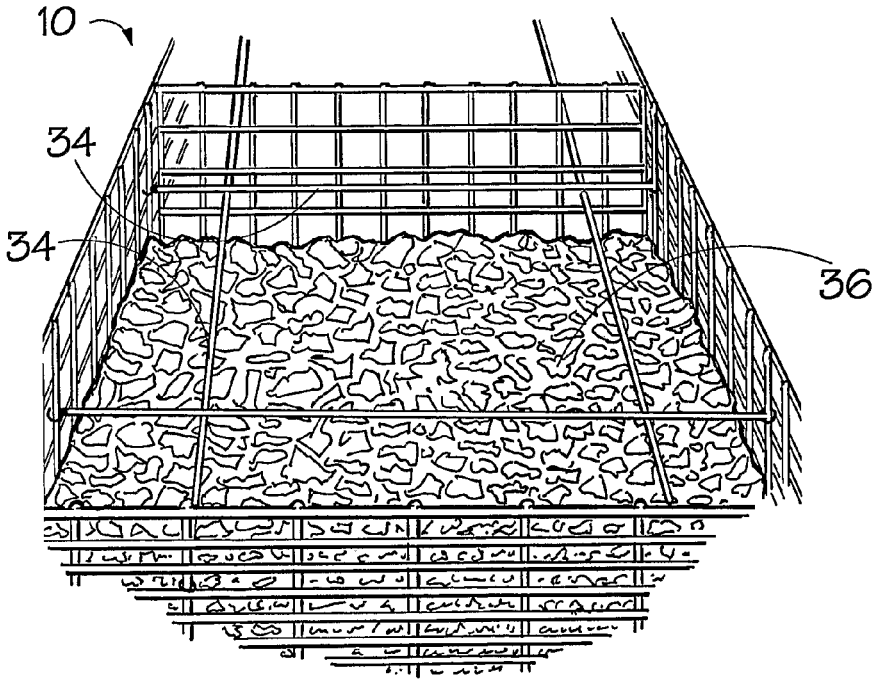
FIG. 7 is a perspective view of a part-filled gabion with the rocks having been leveled and additional bracing wires inserted.

Referring to FIG. 7, when the gabion 10 has been part-filled with rocks 36, the rocks 36 are leveled and additional bracing wires 34 are inserted above the fill level of the gabion 10.

Figure 8:
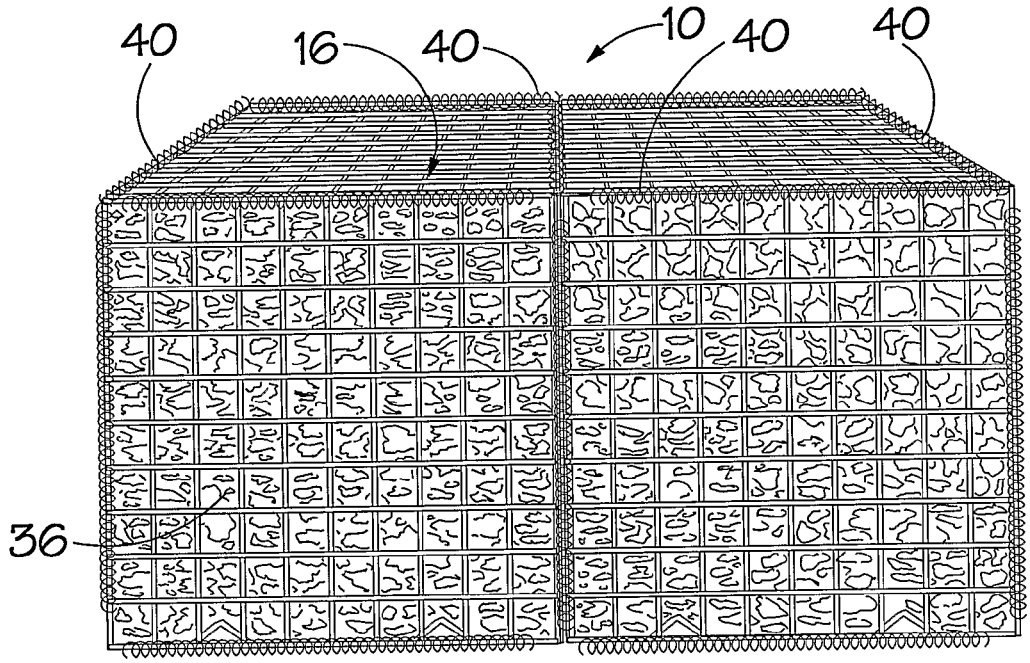
FIG. 8 is a perspective view of a filled gabion in accordance with the invention with a lid in place.
Figure 9:
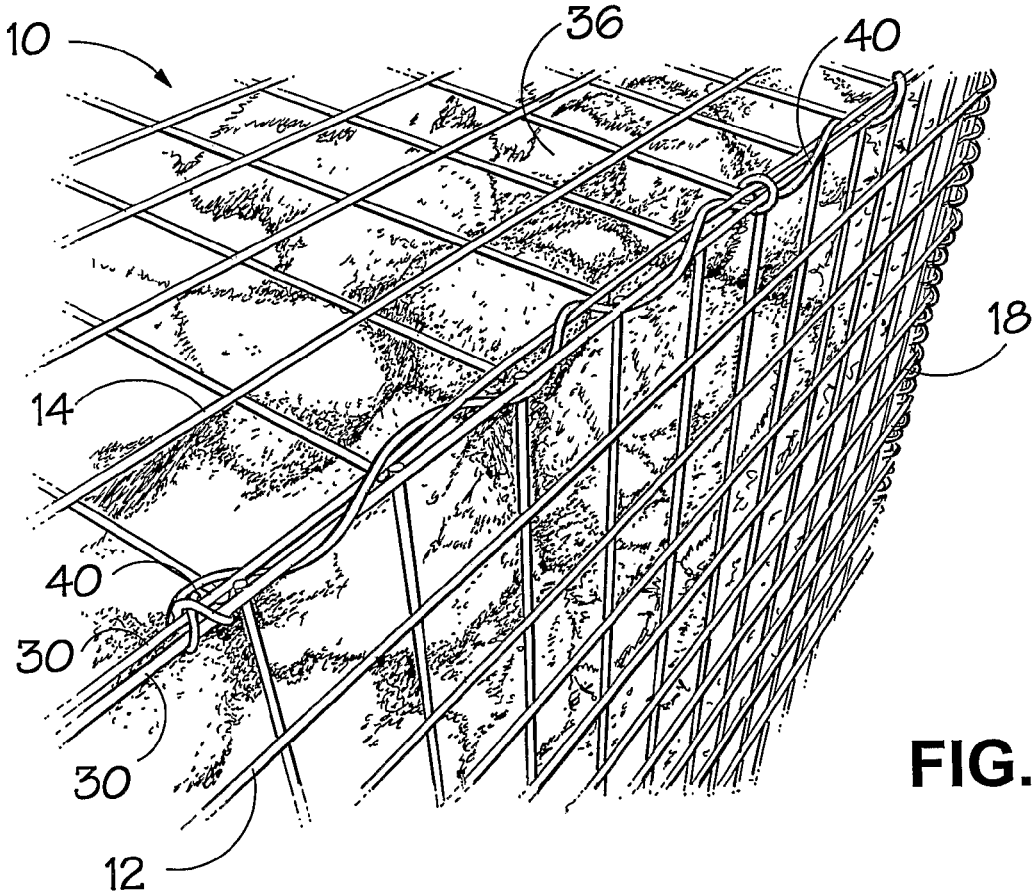
FIG. 9 is a close-up perspective view of the side wall-lid junction.

The filling process is then repeated until the gabion 10 is slightly over-full as shown in FIG. 8. When the gabion 10 is full, the lid 16 is hinged over to close the gabion 10 and lashed in place around its periphery using steel wire 40 as shown more clearly in FIG. 9, or by helical springs.

Figure 10:
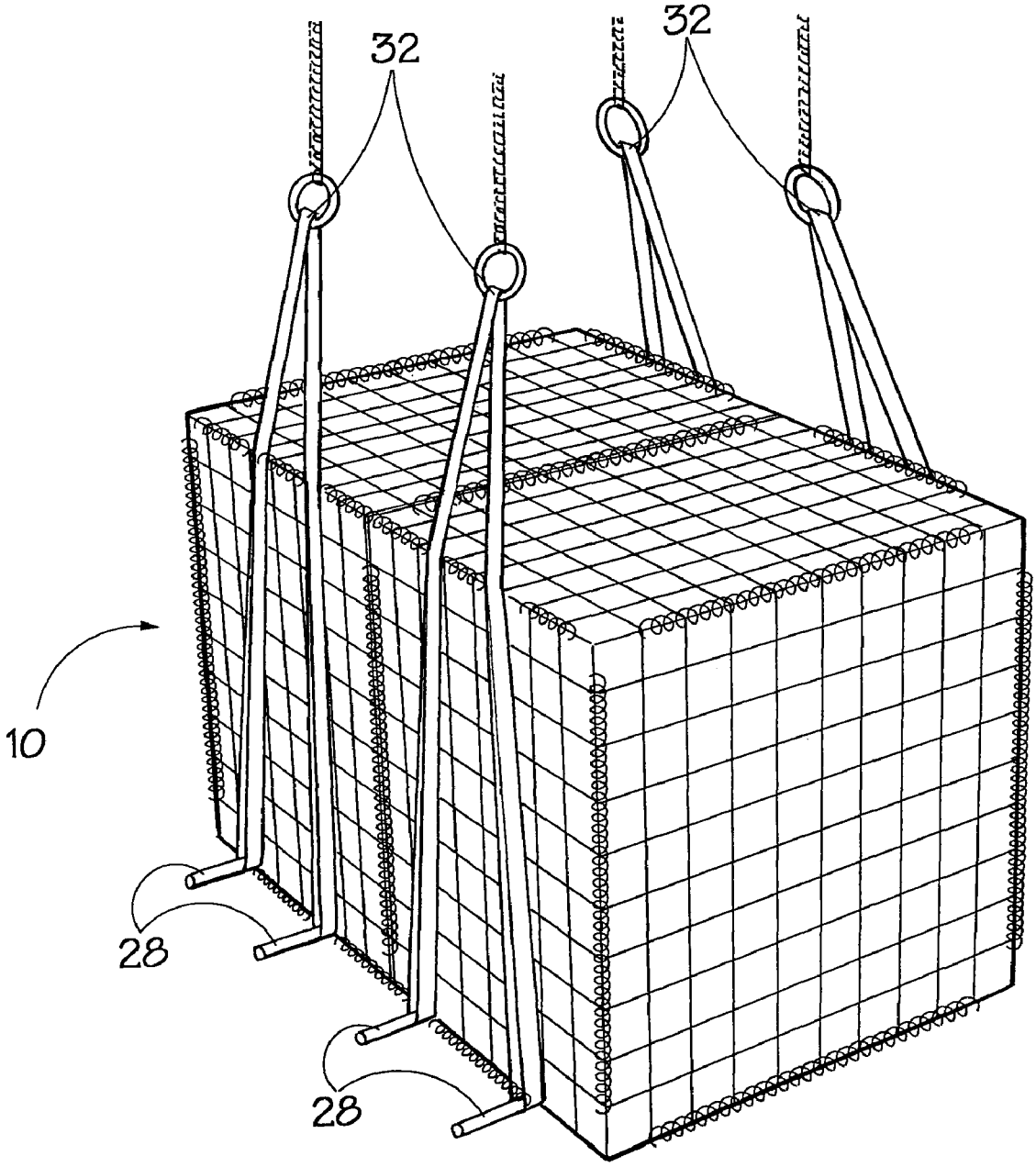
FIG. 10 is a perspective view of a filled gabion in accordance with the invention being hoisted off the ground.

FIG. 10 shown the filled gabion 10 being hoisted off the ground using the lifting straps 32 connected to a crane 42. The gabion 10 can be moved or repositioned as desired and lowered into its new position.

Figure 11:
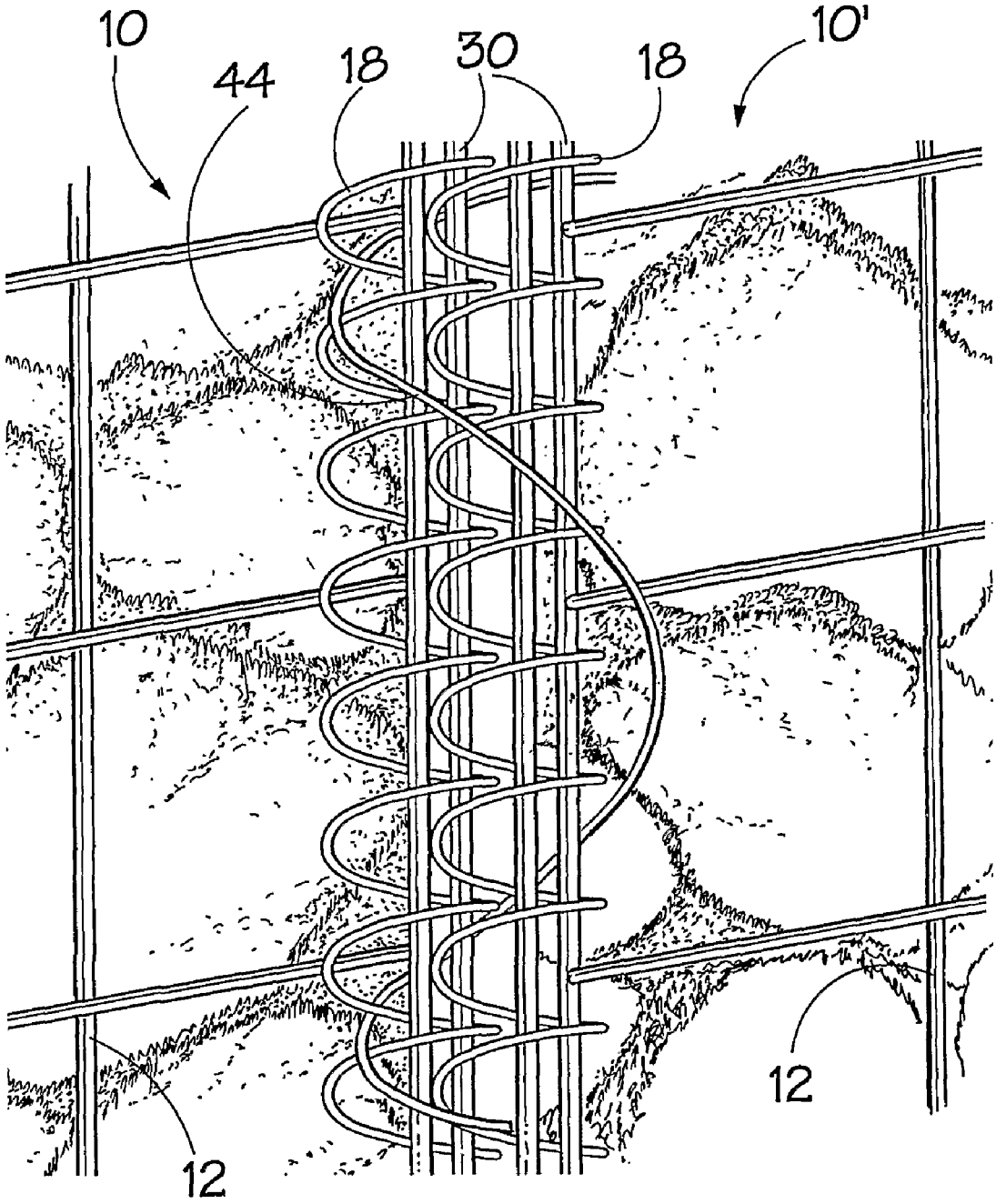
FIG. 11 is a perspective close-up showing how adjacent gabions can be laced to one another.

Once back on the ground, adjacent gabions 10 & 10' can be lashed to one another using wire 44 threaded through edge wires 30 of respective side walls 12 as shown in FIG. 11. Alternatively, staples, joining pins or hog clips could be used to connect adjacent gabions to one another.

Figure 12:
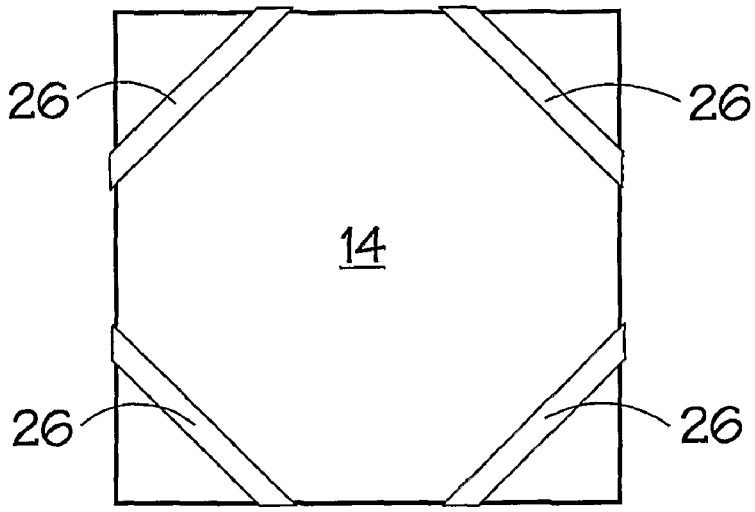
FIG. 12 is a schematic of the gabion base showing an alternative groove configuration.

An alternative base 14 configuration is shown in FIG. 12, whereby the grooves 26 run diagonally across the base 14 and terminate at the edges thereof.

Figure 13:
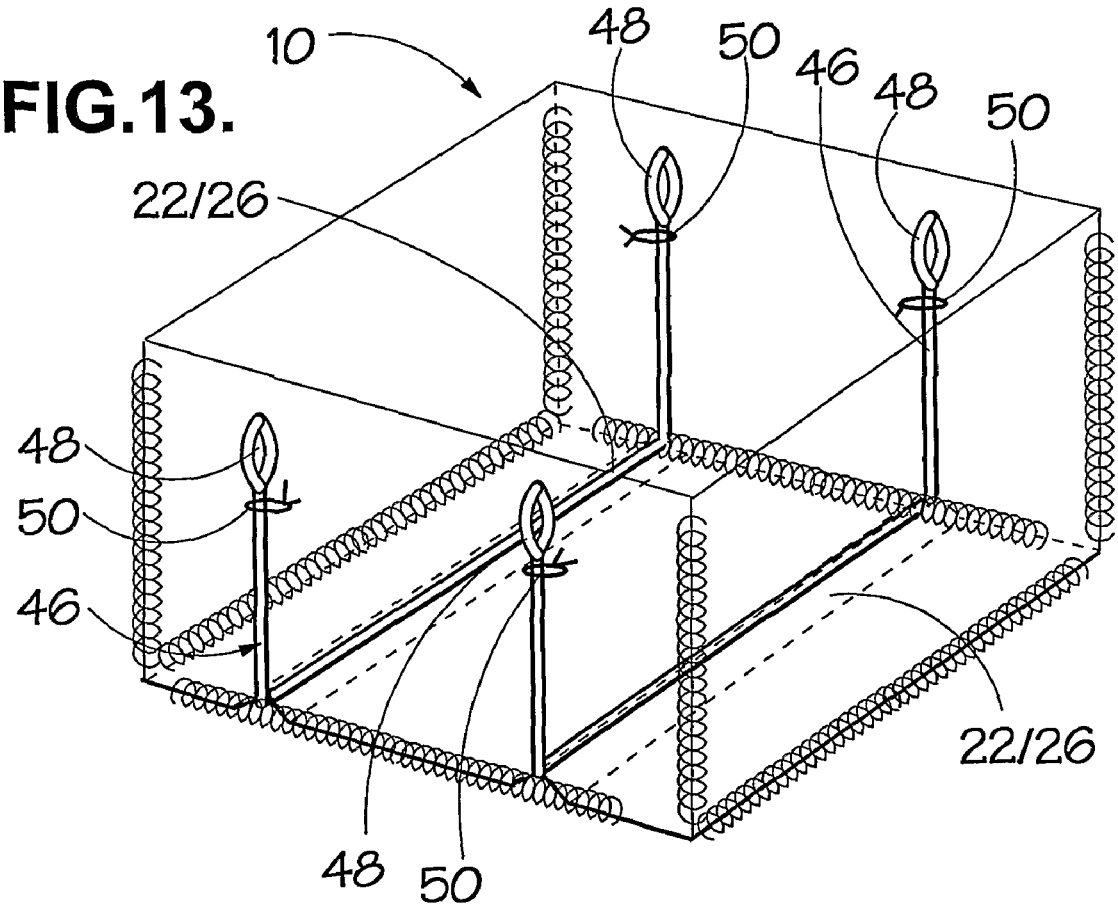
FIG. 13 is a perspective view of a second type of gabion in accordance with the invention.

A further alternative embodiment of a gabion in accordance with the invention is shown in FIG. 13, wherein the lifting bars have been replaced by cables 46. The cables 46 are threaded through the channels 26 defined by the grooves 22. Each end of each cable 46 has an eye 48 to which lifting straps can be attached. The cables 46 are held loosely in place using cable ties 50.

The invention is not restricted to the details of the foregoing embodiments, for example, the ridge could be formed above or beneath a substantially flat base, e.g. by affixing a tubular member to the underside of the base or by providing a cellular or grid-like structure on which the base sits.

Figure 14:
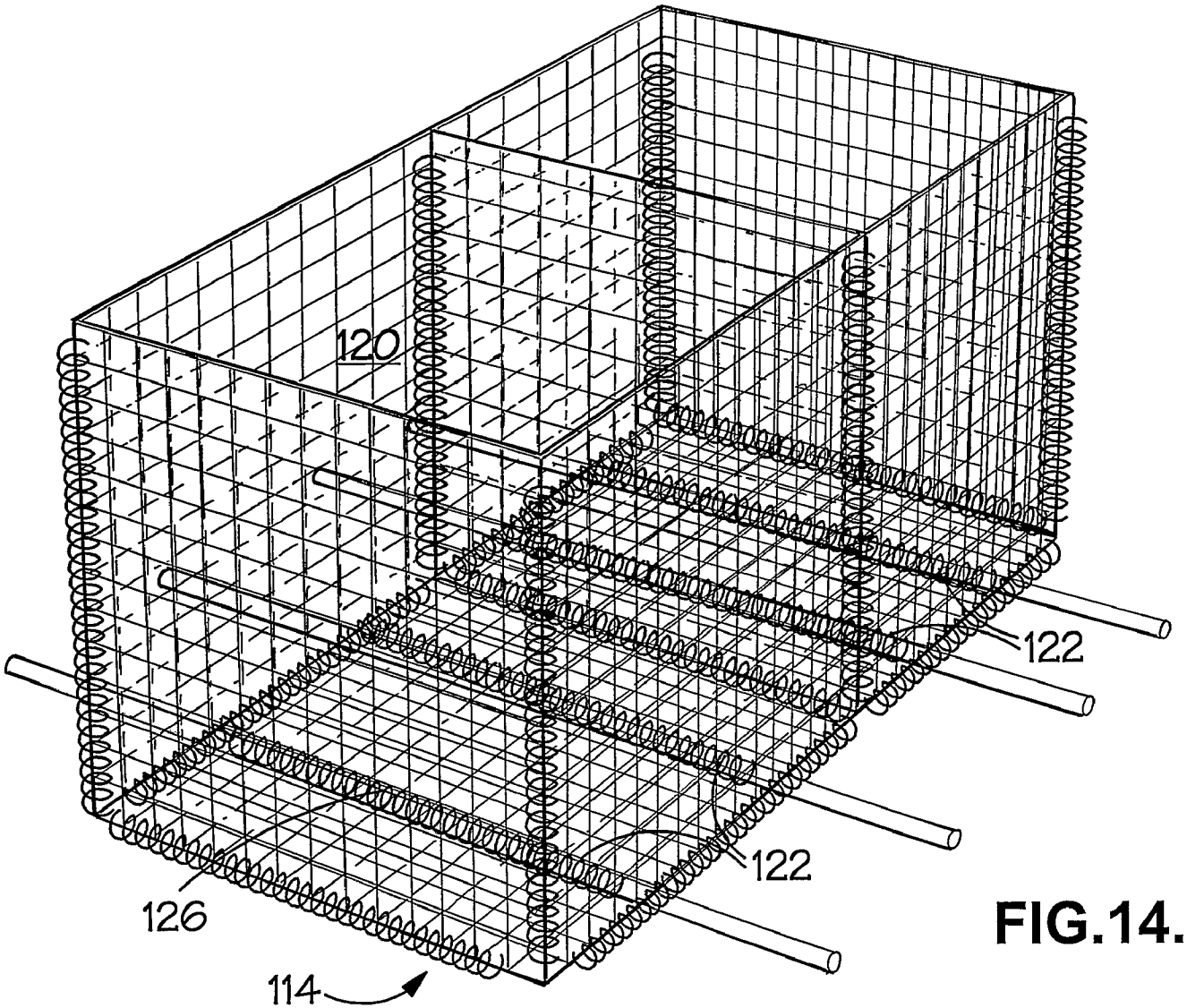
FIG. 14 shows a perspective view of a gabion in accordance with the invention, wherein the channels are defined by helical coil springs connected to the gabion base.

As can be seen in FIG. 14, each path 122 is formed by fixing a coiled member 123 to the base 114 of the cavity 120. Each path 122 defining a channel 126, having openings at either end, and formed so that a lifting bar can be inserted therein, as shown. The coiled member 123 has at least a first and second aperture defining said path wherein the radius of the coil is such that a lifting bar can be inserted therethrough.

Alternatively the coiled member 123 could be replaced with a plurality of longitudinally spaced rings attached to the base of the gabion, so as to define a path 122 capable of receiving a lifting member, wherein the rings can be any appropriate shape. Furthermore, the path 122 could be defined by a substantially tubular member, capable of receiving a lifting member, fixed to the base 114 of the gabion.

Figure 15:
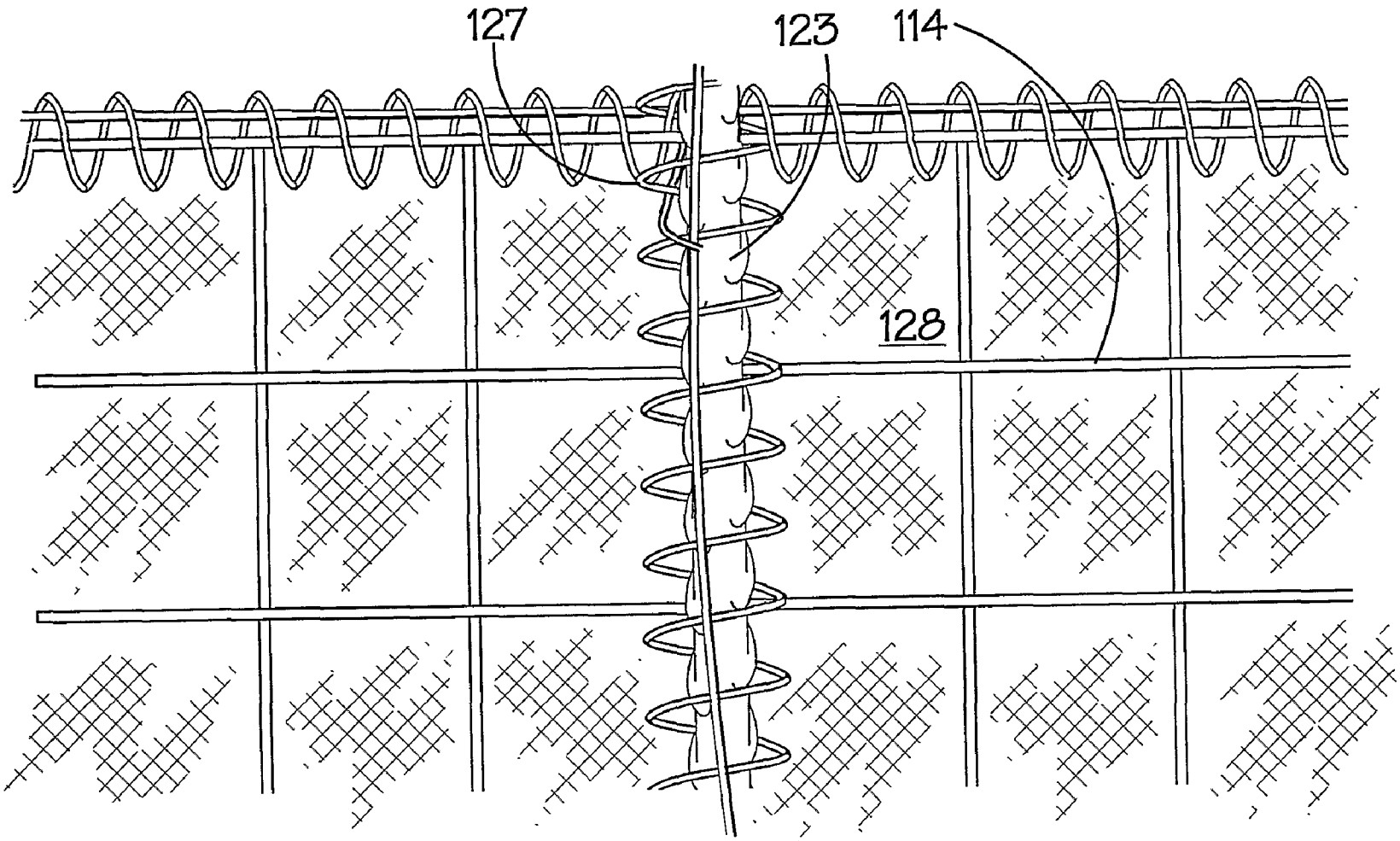
FIG. 15 shows a close-up view of the gabion of FIG. 14, showing the region where a lifting member is inserted through the channel.

FIG. 15 shows in expanded view a lifting bar 128 inserted in the path 122 and extending from a first aperture 127 of the path. Where there is little clearance between the lifting bar 128 and the helical member a hammer may be required to knock the lifting bar 128 into position. As can be seen from FIG. 14, each lifting bar 128 protrudes beyond the periphery of the gabion 10 to allow attachment of hoisting straps.

Figure 16:
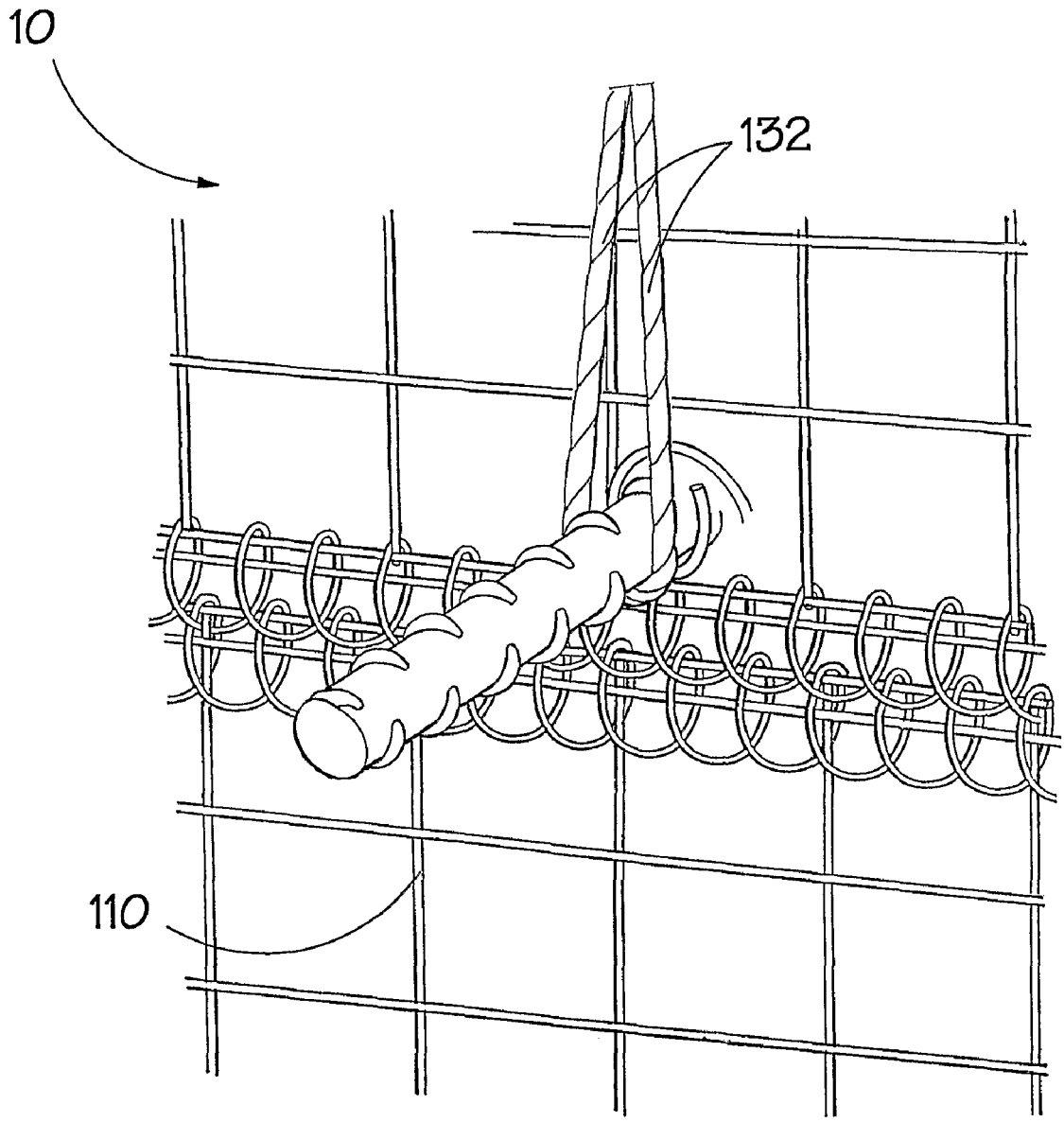
FIG. 16 shows the gabion of FIG. 14 filled and about to be lifted by means of lifting straps secured to the protruding ends of the lifting rods.

FIG. 16 shows the filled gabion 110 being hoisted off the ground using the lifting straps 132 connected to a crane (not shown). The gabion 10 can be moved or repositioned as desired and lowered into its new position.

What is claimed is:

1. A gabion comprising sidewalls defining a cavity suitable for retaining a quantity of fill material and a base closing the bottom of the gabion, the gabion being provided in the region of said base with at least two channels at spaced apart locations along the gabion and connected to or integrally formed with the base and extending from one sidewall of the gabion to another side wall thereof, each channel being adapted to receive therethrough an elongate lifting member such that when the gabion is lifted by means of the lifting members, each lifting member bears against the top of the channel in which it is received and the lifting load is thereby spread along the channels, wherein the channels are formed from elongate pipe or tube members connected to the base and are continuous, defining one top surface against which the lifting members bear during lifting of the gabion thereby.

2. The gabion according to claim 1, wherein the channels are formed of ridges provided in the base.

3. The gabion according to claim 1, wherein the channels extend from one sidewall of the gabion to an opposite sidewall thereof.

4. The gabion according to claim 1, wherein the channels extend from one sidewall of the gabion to a neighbouring sidewall thereof.

5. The gabion according claim 1, wherein in the channels are arranged symmetrically with respect to each other.

6. The gabion according to claim 1, wherein the channels are substantially rectilinear, triangular or circular in cross-section.

7. The gabion according to claim 1, wherein the lifting members are bars, rods or cables, and the gabion is lifted by mechanical lifting means suitably connected to protruding ends of the lifting members.

8. The gabion according to claim 1, further comprising one or more dividers positioned within the cavity for inhibiting movement of the fill material within the cavity.

9. The gabion according to claim 1, wherein at least one of the dividers lies in a vertical plane for preventing lateral movement of the fill material within the cavity.

10. The gabion according to claim 1, further comprising one or more braces within the cavity connecting opposing sidewalls to one another in a relatively inextensible manner.

11. The gabion according to claim 1 comprising a top panel enclosing the filled gabion.

12. The gabion according to claim 1, wherein at least the side walls are pivotally connected together to allow the unfilled gabion to adopt a flattened configuration for storage and transport.

13. The gabion according to claim 1, wherein the gabion is filled and the channels are substantially free from fill material.

14. A gabion comprising sidewalls defining a cavity suitable for retaining a quantity of fill material and a base closing the bottom of the gabion, the gabion being provided in the region of said base with at least two channels at spaced apart locations along the gabion and connected to or integrally formed with the base and extending from one sidewall of the gabion to another side wall thereof, each channel being adapted to receive therethrough an elongate lifting member such that when the gabion is lifted by means of the lifting members, each lifting member bears against the top of the channel in which it is received and the lifting load is thereby spread along the channels, wherein the channels are formed from elongate helical members, where the helical members are formed of coiled spring and the channels are discontinuous, providing a multiplicity of to surfaces along the length of the channels against which the lifting members bear during lifting of the gabion thereby.

15. The gabion according to claim 14, wherein the channels are formed of ridges provided in the base.

16. The gabion according to claim 14, wherein the channels extend from one sidewall of the gabion to an opposite sidewall thereof.

17. The gabion according to claim 14, wherein the channels extend from one sidewall of the gabion to a neighbouring sidewall thereof.

18. The gabion according claim 14, wherein in the channels are arranged symmetrically with respect to each other.

19. The gabion according to claim 14, wherein the channels are substantially rectilinear, triangular or circular in cross-section.

20. The gabion according to claim 14, wherein the lifting members are bars, rods or cables, and the gabion is lifted by mechanical lifting means suitably connected to protruding ends of the lifting members.

21. The gabion according to claim 14, further comprising one or more dividers positioned within the cavity for inhibiting movement of the fill material within the cavity.

22. The gabion according to claim 14, wherein at least one of the dividers lies in a vertical plane for preventing lateral movement of the fill material within the cavity.

23. The gabion according to claim 14, further comprising one or more braces within the cavity connecting opposing sidewalls to one another in a relatively inextensible manner.

24. The gabion according to claim 14 comprising a top panel enclosing the filled gabion.

25. The gabion according to claim 14 wherein at least the side walls are pivotally connected together to allow the unfilled gabion to adopt a flattened configuration for storage and transport.

26. The gabion according to claim 14 wherein the gabion is filled and the channels are substantially free from fill material.

* * * * *